US007658299B2

(12) United States Patent
Billado, Jr.

(10) Patent No.: US 7,658,299 B2
(45) Date of Patent: Feb. 9, 2010

(54) SEALABLE PAINT TRAY ASSEMBLY

(76) Inventor: Harry S. Billado, Jr., 13 Centennial St., Claremont, NH (US) 03743

( * ) Notice: Subject to any disclaimer, the term of this patent is extended or adjusted under 35 U.S.C. 154(b) by 154 days.

(21) Appl. No.: 11/685,097

(22) Filed: Mar. 12, 2007

(65) Prior Publication Data

US 2007/0151975 A1 Jul. 5, 2007

Related U.S. Application Data

(60) Division of application No. 10/889,241, filed on Jul. 12, 2004, now abandoned, which is a continuation of application No. PCT/US03/00980, filed on Jan. 14, 2003.

(60) Provisional application No. 60/349,009, filed on Jan. 14, 2002.

(51) Int. Cl.
*B05C 21/00* (2006.01)

(52) U.S. Cl. ..... 220/570; 15/257.06

(58) Field of Classification Search ..... 220/570, 220/571, 571.1, 572, 697, 735; 15/257.06
See application file for complete search history.

(56) References Cited

U.S. PATENT DOCUMENTS

| | | | |
|---|---|---|---|
| 1,595,965 | A | 8/1926 | Johnson |
| 2,521,122 | A | 9/1950 | Lambourne |
| 2,901,098 | A | 8/1959 | Tupper |
| 3,828,389 | A | 8/1974 | Heisler |
| 3,850,298 | A | 11/1974 | Jolly |
| 4,010,866 | A | 3/1977 | McClane |
| 4,200,949 | A | 5/1980 | Heniff, Jr. |
| 4,372,448 | A | 2/1983 | Drach |
| 4,445,250 | A | 5/1984 | Seidl |
| 4,541,542 | A | 9/1985 | Florentino |
| 4,547,926 | A | 10/1985 | Kern |
| 4,651,379 | A | 3/1987 | Kern |
| 4,669,609 | A | 6/1987 | Lugo |
| 4,802,576 | A | 2/1989 | Kern |
| 4,890,353 | A | 1/1990 | Shannon et al. |
| 5,139,139 | A | 8/1992 | Goetz |
| 5,178,274 | A | 1/1993 | Long |
| 5,273,160 | A | 12/1993 | Malvasio |
| 5,316,137 | A | 5/1994 | Kyllonen |
| 5,489,042 | A | 2/1996 | Ewald |
| 5,511,279 | A | 4/1996 | Ippolito |
| 5,533,228 | A | 7/1996 | Jarecki et al. |
| 5,553,348 | A | 9/1996 | Brandenburger |
| 5,553,701 | A | 9/1996 | Jarecki et al. |
| 5,645,164 | A | 7/1997 | Hocking |
| 5,735,399 | A | 4/1998 | Ste. Marie |
| 5,787,544 | A | 8/1998 | Meade |
| 5,960,946 | A | 10/1999 | Gramlich |
| 5,966,772 | A | 10/1999 | Woodnorth et al. |
| 5,984,129 | A | 11/1999 | Pasinski |
| D485,955 | S | 1/2004 | Johnson |
| 7,083,044 | B1 | 8/2006 | Kilian et al. |
| 2001/0013518 | A1 | 8/2001 | Lallement et al. |
| 2003/0015532 | A1 | 1/2003 | Rickman et al. |
| 2004/0238399 | A1 | 12/2004 | Billado |

*Primary Examiner*—Harry A Grosso
(74) *Attorney, Agent, or Firm*—Grossman, Tucker, Perreault & Pfleger, PLLC

(57) ABSTRACT

A paint tray system including a paint tray and a lid that may be sealed to the paint tray in a generally airtight manner. The shape of the lid corresponds to the interior of the paint tray so that the volume of air sealed in the paint try by the lid is minimized. The underside of the lid may also include a recess that may receive a paint applicator between the paint tray and the lid. The paint tray may also include an applicator rest for holding a paint roller in the paint tray while keeping the handle out of a paint reservoir.

17 Claims, 6 Drawing Sheets

SEALABLE PAINT TRAY ASSEMBLY

CROSS-REFERENCE TO RELATED APPLICATIONS

This is a divisional of U.S. patent application Ser. No. 10/889,241, filed Jul. 12, 2004, which is a continuation application of International Application No. PCT/US03/00980 filed Jan. 14, 2003, and claims benefit of U.S. provisional patent application Ser. No. 60/349,009, filed Jan. 14, 2002, the teachings of which applications are incorporated herein by reference.

FIELD OF INVENTION

This invention relates to plastic and metal paint tray assemblies and paint kits, more particularly to a paint tray assembly that has a sealable lid and a paint kit with a sealable lid and paint applicator such as a roller assembly.

BACKGROUND

This invention relates generally to sealable paint tray assemblies and paint kits, more specifically to a combination wet architectural coating and wet coating applicator storage container, dry storage container, and dry package assembly for sealable paint tray assemblies or paint kits. For convenience of description, reference will hereafter be made to "paint" as representative generally of architectural coatings. References will hereafter be made to "paint kit" as representative generally of a paint tray, lid and paint applicator such as a roller assembly.

Conventional roller painting equipment used by consumers or professionals almost invariably consists essentially of a roller assembly and a paint tray. A batch of paint from a one gallon or other convenient sized container of paint is poured into a tray which usually has a storage capacity considerably less than the volume of the paint container, and the roller sleeve is dipped into the tray as the work progresses until the batch is exhausted, at which time another batch is poured into the tray. It is always hoped that the paint in the tray will be exhausted at the same time as the person applying the paint quits for the day or leaves the job for an extended period of time so that a skin will not form on the paint left in the tray and the paint applicator will not harden due to solvent evaporation, but quite often this does not happen. As a consequence the user has the option of throwing out or cleaning the roller sleeve and pouring the unused paint back into the original container, which is invariably a messy and time consuming process with the potential for spillage on a floor or carpeted surface, or leaving the roller assembly and unused paint in the tray until the user can return to finish the job. If the paint is left in the tray, removing the skin that forms over the paint reservoir is an even messier task than pouring out the unused paint with all the above described disadvantages. In addition, due to solvent evaporation, the now skin free paint will often be thicker than when it was poured from the original container and, as a consequence, the surface cover ability and quality may consequently be lowered. Items like roller sleeves are often replaced once painting is resumed. This becomes expensive to replace the roller sleeves at every new starting point but is often a popular choice rather than the long, messy, and often aggravating process of washing a roller sleeve at any point when the tray and paint accessories are not in use.

Attempts have been made to address the above disadvantages but none to our knowledge has been sufficiently successful. For example, a number of proposals have been made involving a mating lid for a tray but many, and possibly a majority, of said proposed structures attempt to make a provision to also contain paint accessories such as roller assemblies, brushes and pads in the closed space formed by the tray and associated lid. An assembly of items such as a tray, lid and a paint applicator can be referred to as a paint kit. Such past construction has however had inherent disadvantages when used as wet storage units in that all, or nearly all, trays include an inclined ramp near the front thereof for the purpose of "rolling out" or distributing a fresh roller sleeve load of paint after dipping into the paint reservoir so that the paint is evenly distributed on the roller sleeve prior to application to a receiving surface. The surface of the inclined ramp becomes coated with wet and sticky paint when in use and hence if an applicator handle is laid thereon preparatory to closing the lid on the tray, the handle becomes sticky and unusable thereby requiring cleaning prior to recommencing use.

Further attempts have been made to address the above disadvantages and in focusing on this particular disadvantage, created other problems. For example, some proposals have included additional structure to hold the handles of both the brush and roller assembly away from the wet ramp by extending the handles outside of the tray when the lid is closed. This of course lends itself to accidental tripping on and kicking of the tray assembly and it also uses as much as twice the space necessary to store the tray assembly with protruding applicator handles while not in use.

In some instances it is a requirement of a commercially practical tray assembly that the assembly function as a package so as to provide the option to the ultimate consumer of combining the tray assembly with an appropriate paint applicator such as a roller assembly, mini roller assembly and pads so that a paint kit is formed. There is accordingly a need for a tray assembly having a paint receptacle and a lid which provides a liquid tight, and virtually air tight, container when holding paint between active uses of the tray assembly and yet is easily assembled when the tray assembly is intended to function as a wet storage unit, and easily disassembled when the tray assembly is opened for active use. There is also a need for a paint kit consisting of at least a paint applicator and a tray assembly as above described, which displays the paint applicator and the tray assembly in a visually appealing manner when presented to potential purchasers in a retail outlet.

In addition to the foregoing requirements a tray assembly consisting of a tray and lid only, must occupy a minimal cubic space for manufacturing, shipping and displaying purposes. In effect, the trays should be nestable, the lids should be nestable, and a plurality of lids should add only a minute fraction of bulk to an equal number of trays so that manufacturing, shipping and displaying steps may be carried out at the lowest possible cost and least inconvenience. In this connection the lid should have surfaces to accommodate labels and other externally applied point of purchase marketing aids which assist in the selling potential of the tray assembly and roller assembly. If the lid is made from a clear plastic material a label on the underside of the lid will present the product for sale and, by turning over the lid, will provide use instructions.

SUMMARY OF INVENTION

A tray assembly including of a paint tray and a matching lid which, when assembled, forms a sealed container effective to maintain paint or other coating material and a paint applicator in a stable condition; that is, for an extended period of time without a skin forming on the paint or allowing the paint applicator to harden while not in use. In addition, the sealed tray assembly may dramatically reduce the volatile organic compound emissions inherent in paint from entering the atmosphere. The seal feature may be formed by a means for locking the lid to the tray by mating projecting flanges on the underside of the lid and the top edge of the tray.

The tray assembly may include a paint tray having the features above described in combination with an internal applicator rest for maintaining a supplemental applicator, such as a roller assembly, out of contact with the paint in the paint reservoir portion of the tray. The tray may also feature a recess or concave shape at the top of the incline ramp where the roller sleeve portion rests once the end of the roller assembly handle is placed in the internal applicator rest. This concave shape allows the user to fix the roller assembly's sleeve portion within it when the tray is in use and tow the tray around the work area without having to bend down to manually pick up the tray and risk injury to the user and to avoid accidental spillage. To assist the tray tow feature, the front area opposite the paint reservoir or the front legs of the tray, may be formed in an inward or outward curve to enable smooth transport. To further assist the tray tow feature, the back of the tray opposite the front legs and directly under the paint reservoir may include a second pair of legs that are rounded to assist in the smooth transport of the tray across the work area. Further more, the tray's bottom, directly under the paint reservoir may be elevated off the floor to minimize the friction and resistance against the tray assembly when pulled or towed across the floor.

The lid of the invention could be manufactured by a thermoforming process whereby; minimal material and forming costs are incurred in the manufacturing process. But most likely, the same manufacturing process will be used for forming both the tray and lid which would be an injection molding process to insure a proper fit and seal which would produce a better quality product. In addition, the lid and tray could be constructed so that like parts nest within one another to thereby realize maximum savings in shipping and handling costs when not sold as a kit. When the lid is sealed, the lid's surface just over the paint reservoir portion of the tray may be concaved inward in two halves stopping at a point just above the maximum paint fill line located on the tray in the paint reservoir portion. These two half portion of the lid may be separated by the location of the roller assembly handle when placed in the internal applicator rest. When the lid is sealed on the tray with the roller assembly in its proper location within the tray, the front portion of the lid's surface just over the roller sleeve portion of the roller assembly is convex in shape and forms closely around the roller sleeve portion. When the lid is properly sealed on the tray, and the roller assembly is properly located in the internal applicator rest, the above described lid closely mirrors the internal paint reservoir, and inclined ramp of the tray and the inclusive paint roller assembly. The purpose of this is to displace as much air within the sealed tray assembly to maximize and extend the period of time without a skin forming on the paint and the hardening of the paint roller sleeve portion of the roller assembly.

When the lid is opened and the tray assembly is in use, the inside of the above described lid may double as an additional paint applicator workstation. Popular paint applicators other than the standard nine-inch roller assembly are brushes, mini roller assemblies and pad applicators. In conventional paint trays and paint kits with or without lids, there is simply no place for these additional paint applicators to rest when not being used. These items are typically placed on paint cans, drop cloths, or are balanced on the corners of the conventional paint tray. Accidents in this regard occur far too often and add aggravation to an already difficult task.

Other advantageous features of the invention will become apparent from the following description of the invention.

BRIEF DESCRIPTION OF THE DRAWING

Advantages of the present invention will be apparent from the following detailed description of exemplary embodiments thereof, which description should be considered in conjunction with the accompanying drawings, in which.

DESCRIPTION OF THE INVENTION

Figure 1:
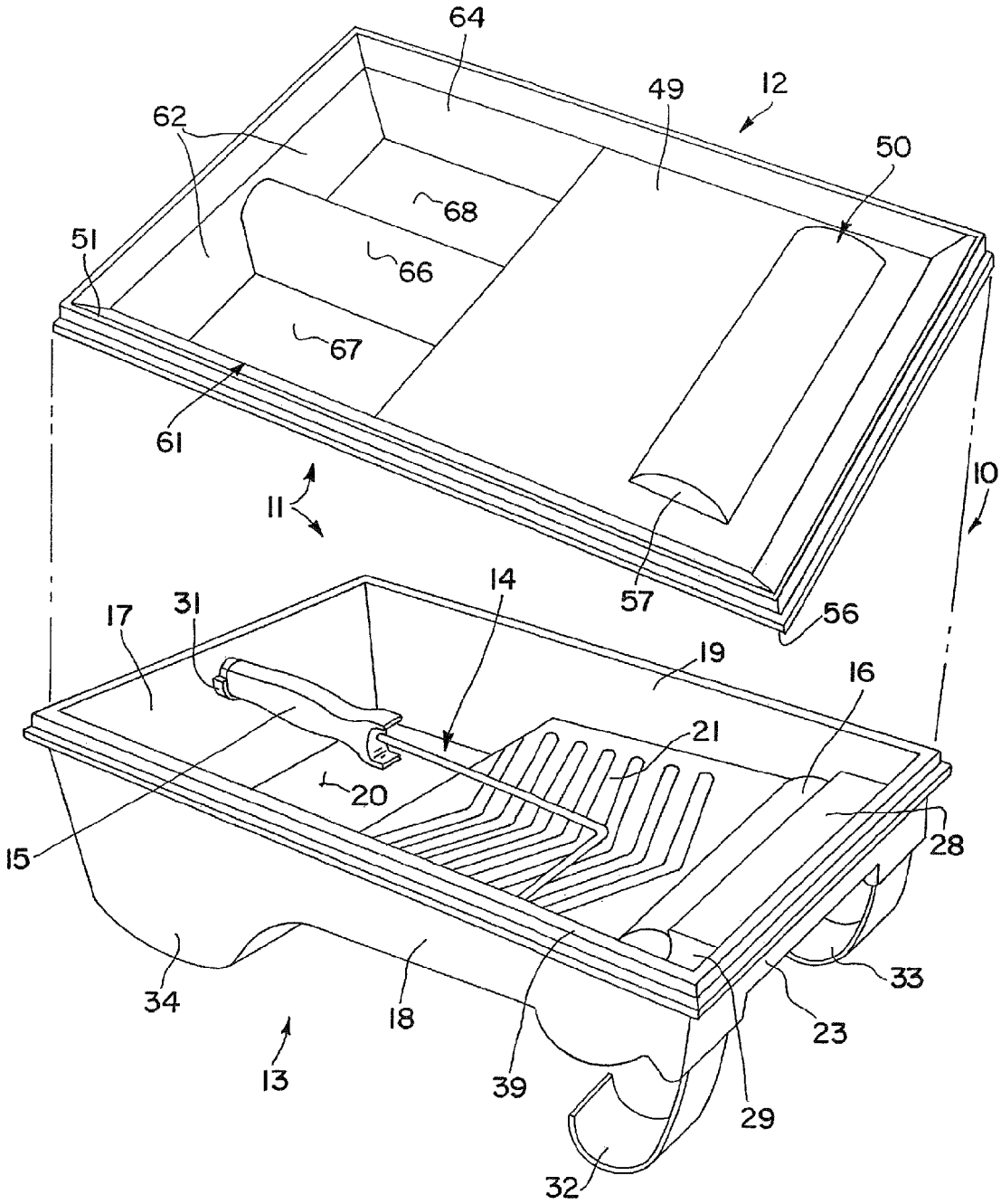
FIG. 1 is an exploded perspective view of a paint kit consistent with the invention, the paint kit including, a sealable tray assembly consisting of a separate lid which may be assembled and disassembled from the tray body and a paint applicator such as a roller assembly.

In the following description of a specific embodiment like reference numerals will be used to refer to like or similar parts from Figure to Figure in the drawing.

Figure 2:
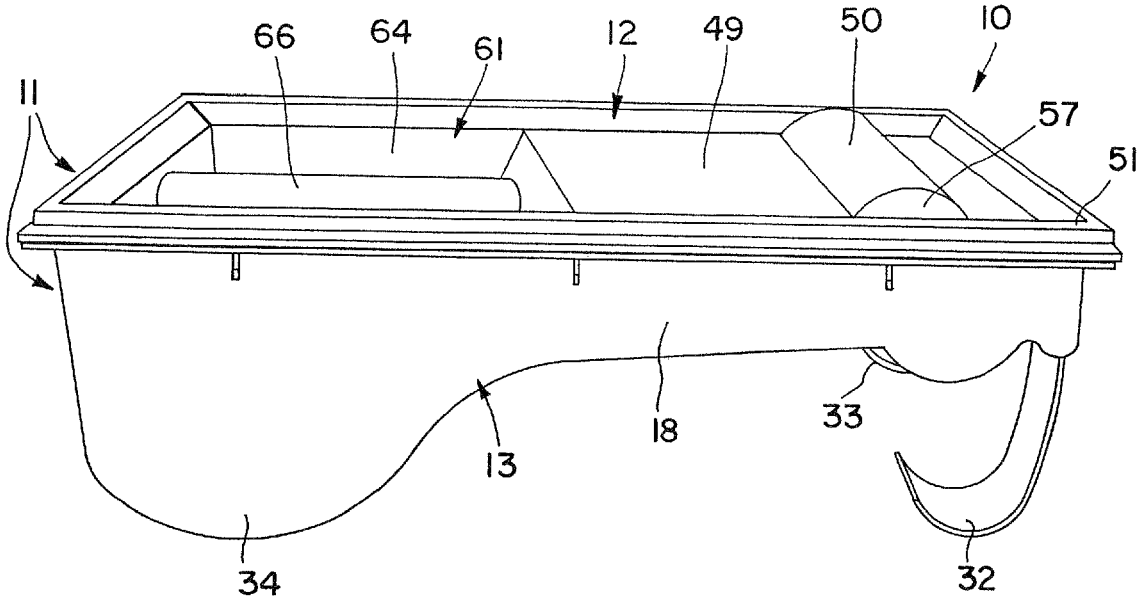
FIG. 2 is a perspective side view of the sealable tray assembly showing the lid in sealing engagement with the tray body.
Figure 3:
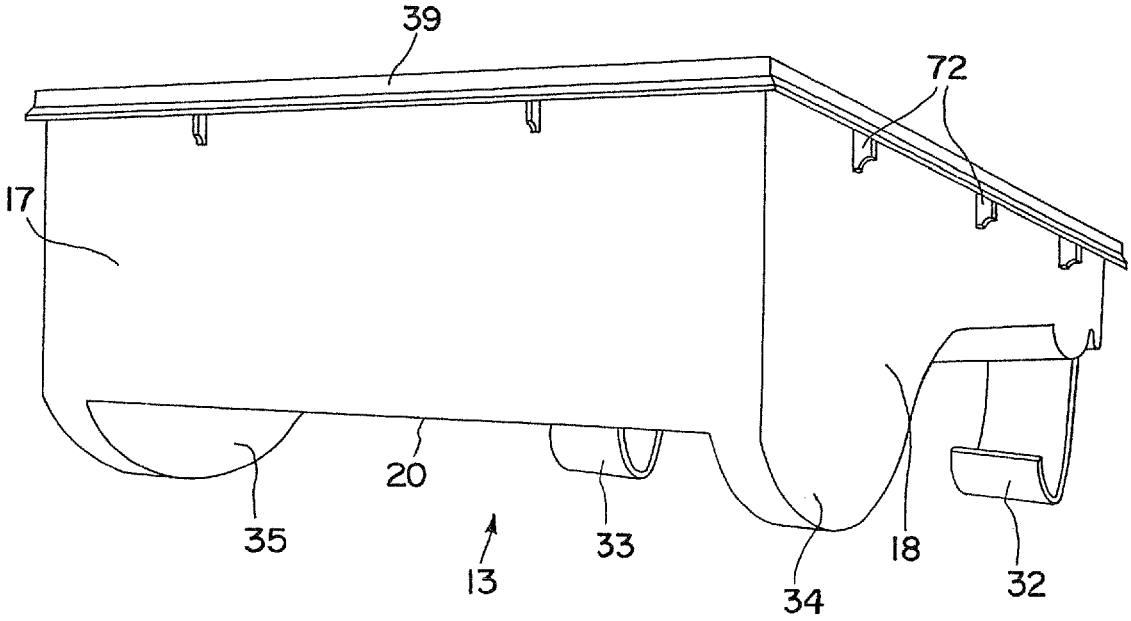
FIG. 3 is a perspective left end view of the tray body as shown in FIG. 1.

Referring first to FIG. 1, the paint kit of this invention is illustrated generally at 10 in an exploded, disassembled condition. The paint kit 10 includes a tray assembly indicated generally at 11, the tray assembly consisting of a lid indicated generally at 12 and a tray body indicated generally at 13. The kit 10, in addition to the tray assembly 11, also includes a paint applicator indicated generally at 14, here a roller assembly. The roller assembly 14 may include a handle 15 and a sleeve portion 16. In FIG. 1 the lid and tray are shown in an unassembled, exploded condition whereas in FIG. 2 the lid and tray are shown sealed and assembled.

Figure 8:
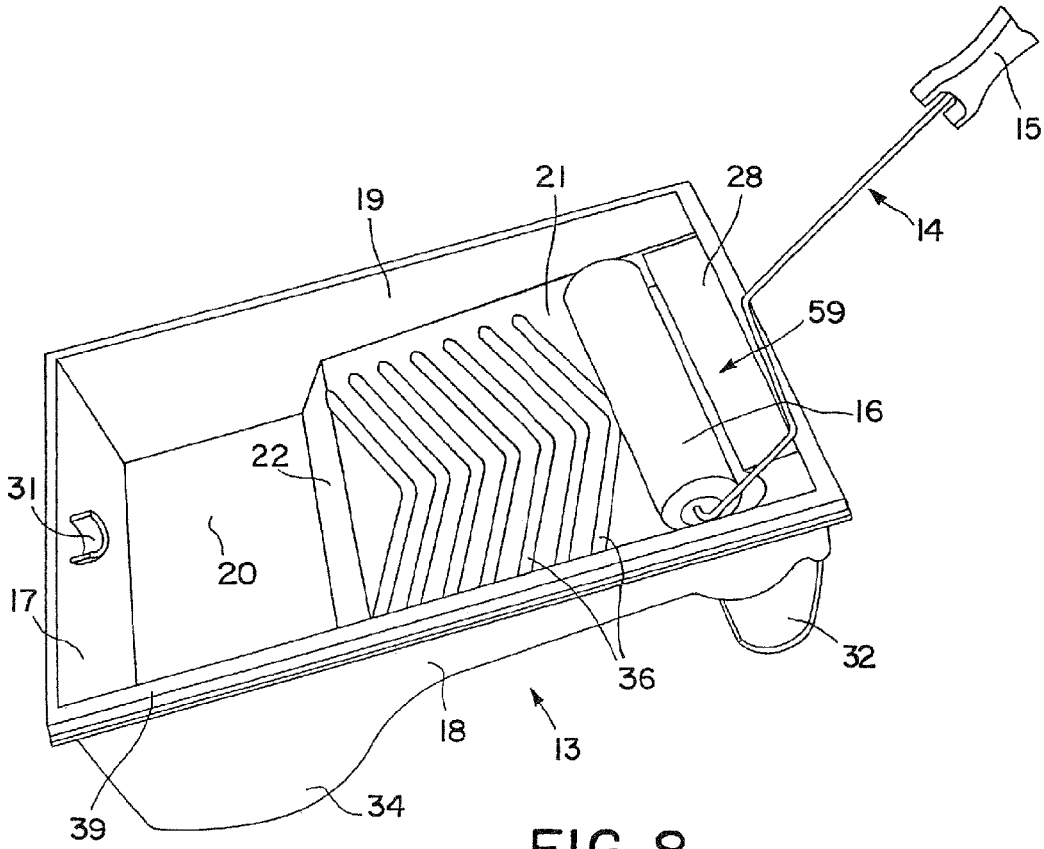
FIG. 8 is a perspective of the tray body at a position, which illustrates the roller assembly towing the tray body.

Tray body 13 of tray assembly 11 includes rear wall 17, left wall 18, right wall 19, and bottom wall 20. The upper peripheral co-planer edges of rear wall 17, left and right side walls 18 and 19 and front wall 23, terminate in an outwardly projecting flange 39. The front end of the tray body 13 may be include several elements including, an incline ramp 21, which terminates at a down turned plane 22, best seen in FIG. 4. A generally vertically disposed portion of the front wall is indicated at 23, wherein the wall portion 23 desirably flanks a concave section 24 that conforms to roller sleeve portion 16, of roller assembly 14. The concave section 24 includes left and right vertical sides 25, 26. A tray towing section, indicated generally at 59, may be located on front wall, as best seen in practice in FIG. 8, including a continuing concave section 27 blending smoothly into concave section 24 and a top plane 28, which terminates at front-most wall 23. The concave section 27 includes left and right vertical sides 29, 30. An interior applicator rest 31, formed generally in a U-shape, or similar upwardly opening protrusion, best seen in FIG. 5, may be disposed extending inwardly from interior of wall 17. Roller assembly handle 15, may rests in applicator rest 31 when roller assembly is not in use. A pair of legs may be formed descending from front-most wall 23, indicated at 32, 33 which terminate in an inward and upward curve. A second pair of legs 34, 35 opposite legs 32, 33 may be provided to support the rear of the tray body 13 and keep bottom wall 20 sufficiently elevated off any surface for which the paint tray is set. The legs 34, 35 may be shaped in an open U-shape or curve. The floor of the inclined ramp 21 is preferably provided with a plurality of ribs 36 and a pair of paint draining channels 37, 38 arranged on either side of the ribs for removing excess paint from the roller sleeve portion 16 in a conventional manner.

Lid 12 includes a flat portion 49, which surrounds a convex section indicated generally at 50 near the front end of lid. The convex section 50 may be formed as an upwardly and outwardly protruding hemi-cylindrical section that that may be bounded by left and right vertical sides 57, 58. Flat portion 49 preferably terminates at a trough indicated generally at 61 near the rear end of lid 12. The trough 61 may be formed by downwardly and inwardly inclined rear wall 62, left and right downwardly and inwardly inclined side walls 63, 64, respectively, and a front wall indicated generally at 65. Front wall 65 and rear wall 62, may be connected by a convex section 66, that divides the bottom wall into two equal halves indicated at 67, 68. The outer peripheral co-planer edges of rear wall 62, left and right side walls 63 and 64 and flat portion 49, terminate in an outwardly projecting flange 51. The outwardly projecting flange 39 of tray body 13 may mate with the outwardly projecting flange 51 of lid 12 to seal the paint kit 10. The convex section 50 and left and right vertical sides 57, 58 form an abutment, which mechanically blocks movement of paint applicator 14 in a parallel direction as next described.

Figure 4:
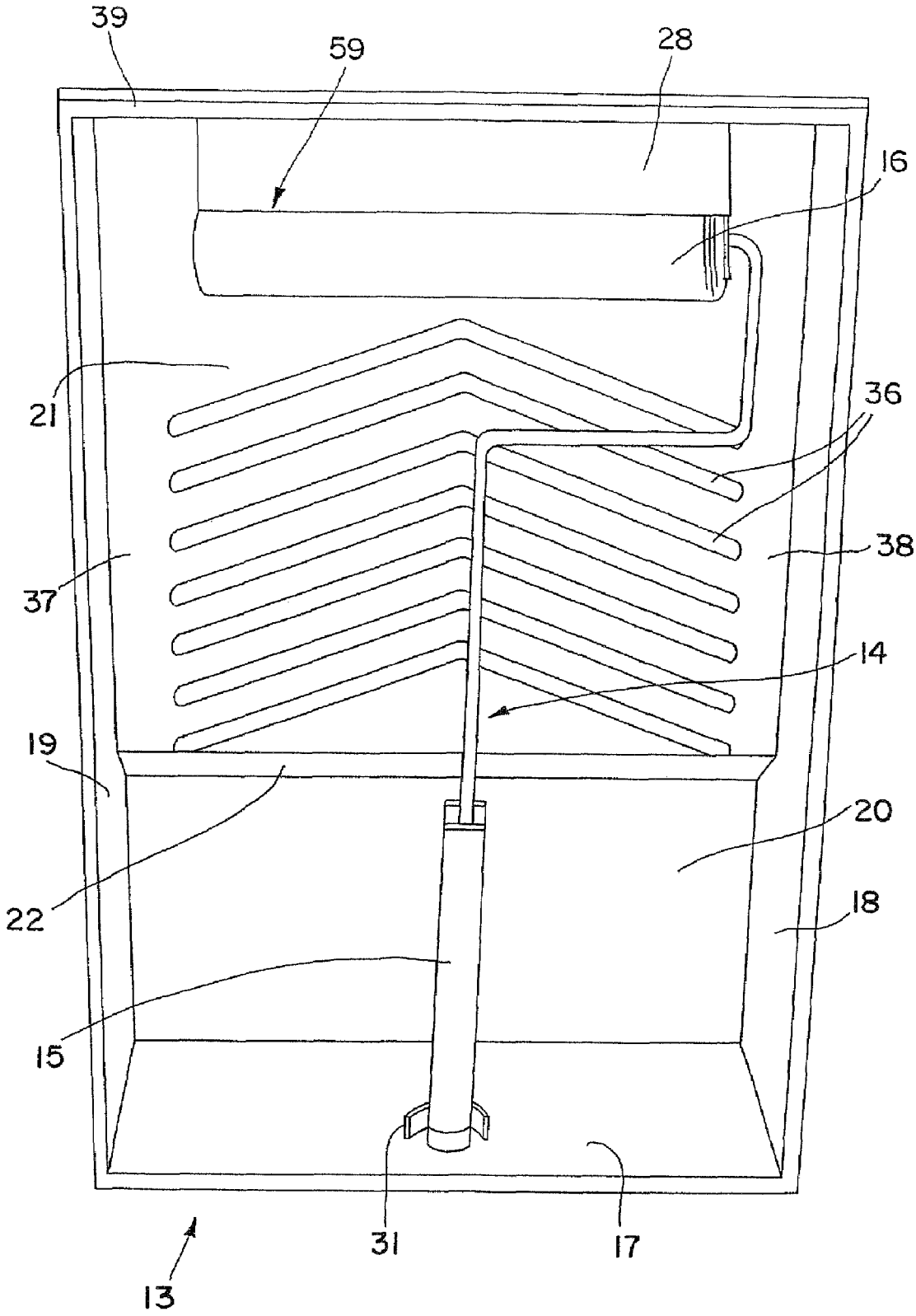
FIG. 4 is a top plan view of the interior features of the tray body and a roller assembly properly placed in the internal applicator rest and concaved section of inclined ramp.
Figure 5:
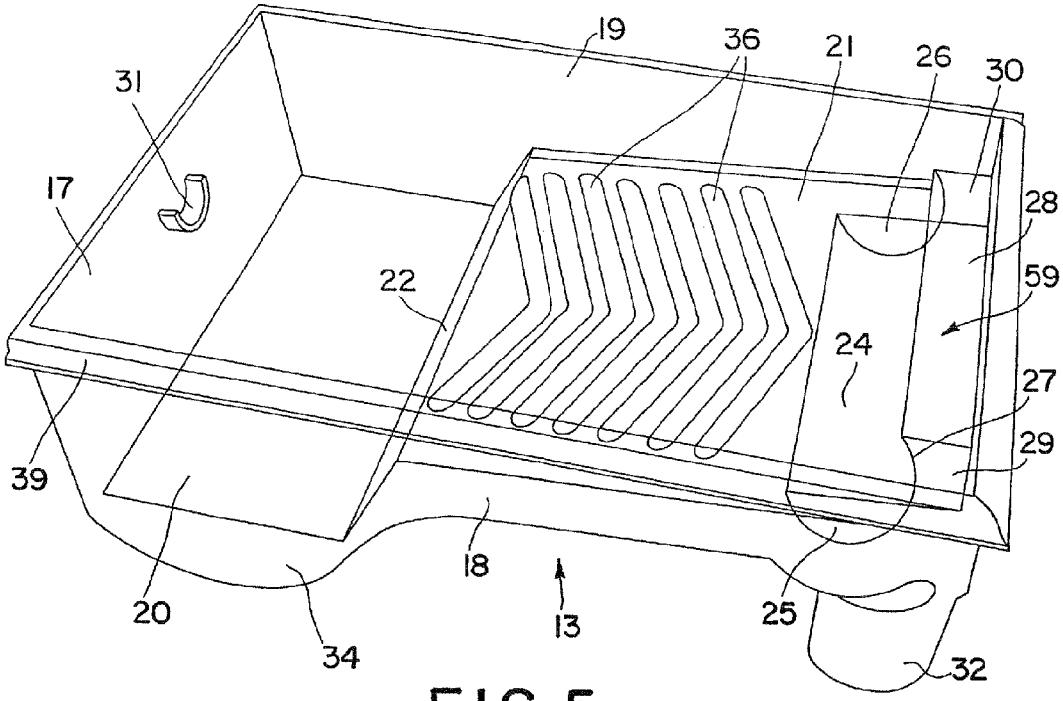
FIG. 5 is a section through the tray body taken at a position, which illustrates the roller assembly in side elevation.

As best seen in FIGS. 1 and 4 the tray body 13 is preferably dimensioned to entirely receive the roller assembly 14 within the cavity formed in tray body 13, such that the roller sleeve portion 16 may be generally received at 59, and the roller handle 15 generally received in the interior U-shaped applicator rest 31 extending inwardly from the interior wall 17. The roller assembly 14 preferably remains sufficiently above the surface of the inclined plane 21 to prevent contact therewith, or contamination with any pain thereon. The lid's convex section 50 in conjunction with concave section 24, that preferably blends smoothly into concave section 27 of tray body 13 and with U-shaped applicator rest 31 fixed on the interior of wall 17, acts as a stationary abutment to block movement of the roller assembly 14 in a parallel direction as best viewed in FIGS. 1 and 4. The length of the roller assembly with respect to the distance between front wall 23 and rear wall 17, may be so dimensioned that the roller assembly 14 is locked into the position with only slight variation, in all angular orientations of the paint kit 10 with respect to the vertical; i.e., from the vertical position of FIGS. 1 and 4 to a position ninety degrees tilted with respect thereto and all angles there between. Thus, whether the paint kit 10 is displayed for purchase in the vertical position or in a horizontal position ninety degrees removed from that position, the paint applicator 14 will generally retain its same relative position with respect to the tray assembly 11, and hence an orderly, eye pleasing appearance of the paint kit 10 will always be presented to the retail customer. It will be understood of course that the width of any paint applicator, such as the roller assembly 14 used in the above described fashion, may be slightly less than the inside dimension of the two walls 17, 23. Such slight clearance is not sufficient however to permit any paint applicator, such as a paint roller assembly 14 to become skewed with respect to the paint tray assembly 11 so that the orderly appearance of the paint kit 10 is maintained at all times.

Figure 6:
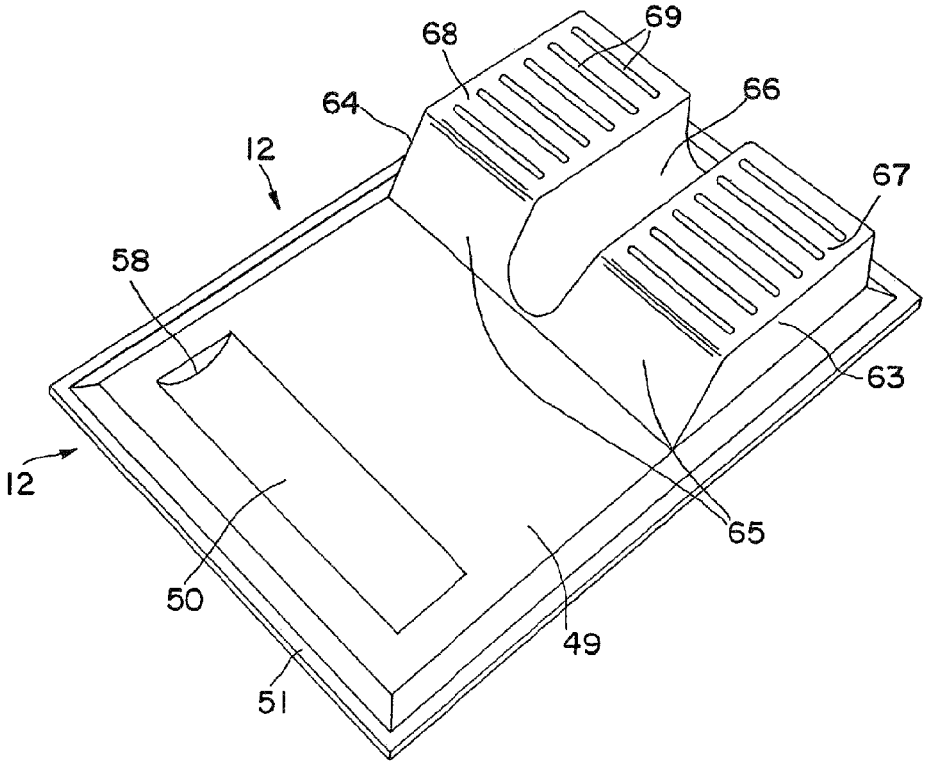
FIG. 6 is a perspective of the inverse view of lid as seen in FIG. 1.
Figure 7:
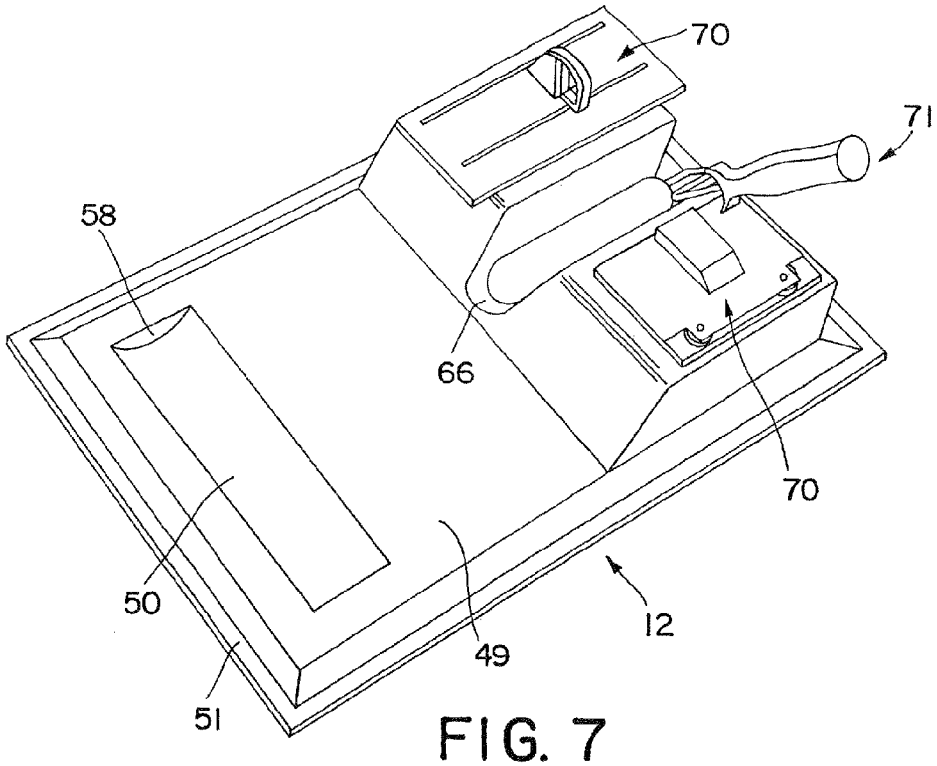
FIG. 7 is a perspective of the inverse view of lid as seen in FIG. 1 with additional paint applicators.

The inverse, or inside, of lid 12, as best seen in FIGS. 6 and 7, illustrates the underside of lid 12, as it would look when tray assembly 11 is in use and open. The bottom walls 67, 68 are preferably provided with a plurality of ribs 69 for removing any excess paint from paint pads 70 and the inverse of convex section 66 of the lid 12 is now a concaved section, and may be used, for example, to hold a mini paint roller assembly 71. Similarly, section 50 of lid 12 can now be used to rest an additional roller assembly if necessary, while the tray assembly is in use.

It should also be noted that paint kit 10 has a separate utility. Thus, since a good seal is desirably formed between the lid 12 and tray body 13 with the two parts may function as a sealed container for holding paint and a paint applicator, such as a roller assembly 14 between uses of the paint kit 10. Thus, should the user not be able to complete a project and be forced to terminate work before the paint stored in tray body 13 is used, the lid 12 may be snapped onto the tray body 13 and the paint and roller assembly 14 be left overnight or longer with a lessened degree of solvent evaporation and the emissions of volatile organic compounds inherent in paint into the environment, and the consequent formation of a skin on the paint and the hardening of paint on the paint applicator when the paint kit 10 is not in use.

Figure 9:
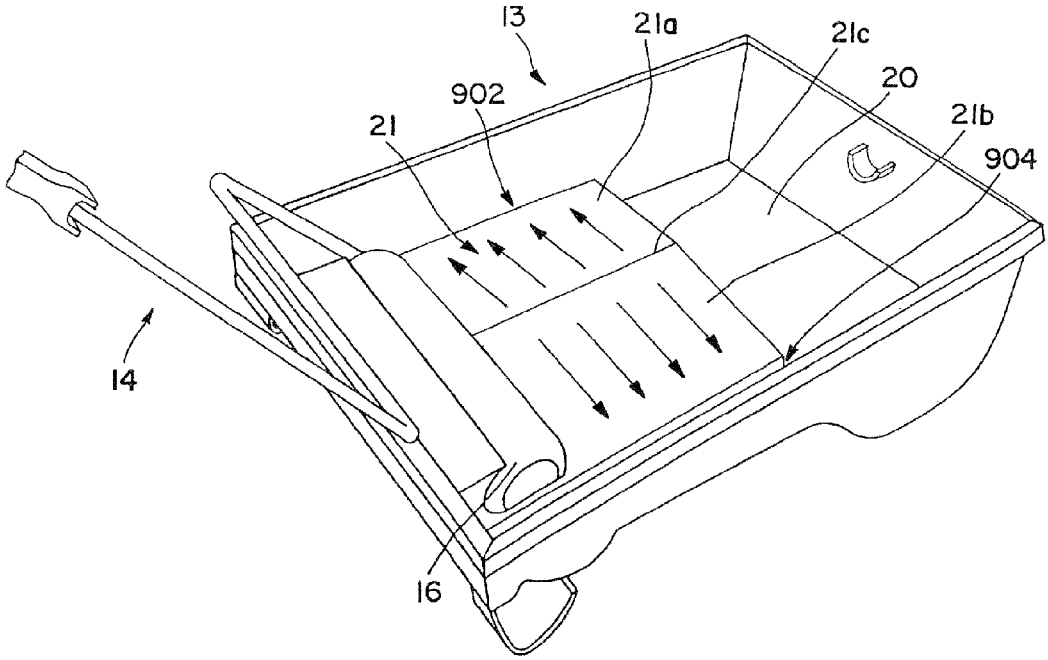
FIG. 9 is a perspective view of a tray body according to another embodiment of the present invention having a pitched tray body.

Turning to FIG. 9, another embodiment of the present invention includes a tray body 13 having a pitched inclined ramp 21. The inclined ramp 21 includes a first portion 21*a* and a second portion 21*b* positioned to form an apex 21*c* of the ramp 21. As such, the first portion 21*a* and the second portion 21*b* are angled downward from the apex 21*c* forming a pitched ramp 21 such that excess paint from the sleeve portion 16 of the roller 14 advantageously also runs downward as indicated by the arrow lines on the first portion 21*a* and second portion 21*b* of the inclined ramp 21. The excess paint also runs downward off the first portion 21*a* and second portion 21*b* into associated drain lines 902 and 904 on either side of the outer edges of the tray body 13. Each drain line 902, 904 is further sloped downward to the reservoir of the tray having a bottom wall 20.

Figure 10:
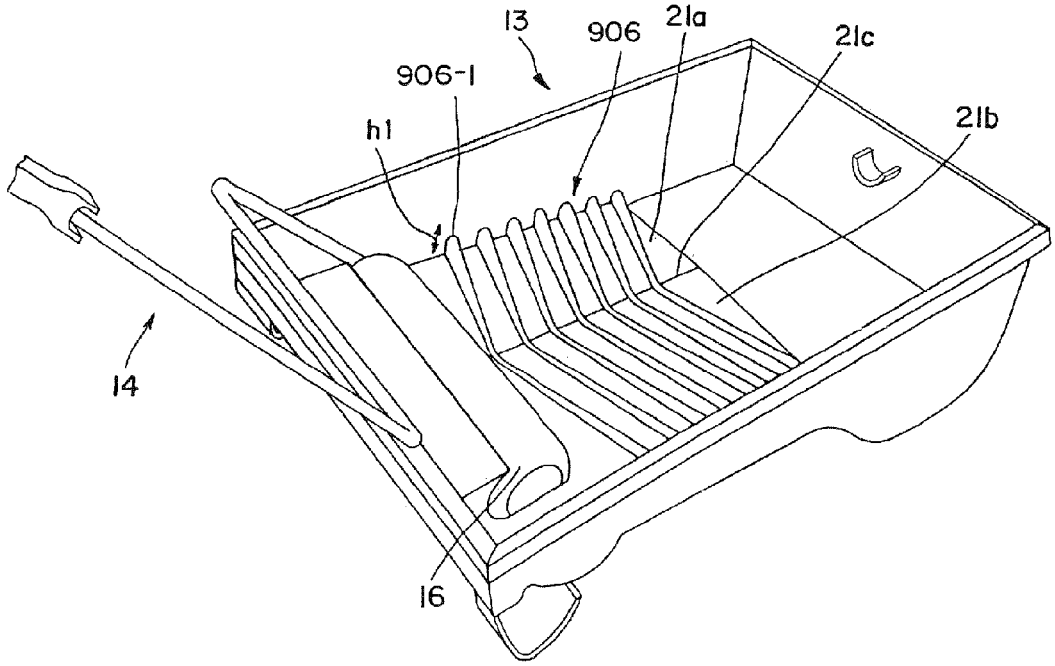
FIG. 10 is a perspective view of the tray body embodiment of FIG. 9 illustrating a plurality of ribs of varying height on the pitched tray body.

Turning to FIG. 10, the inclined ramp 21 of FIG. 9 may advantageously have a plurality of ribs 906 of varying height. The height of each rib may be varying in order to compliment the slope of the first portion 21*a* and second portion 21*b* of the inclined ramp 21 such that the top surface of each of the plurality of ribs 906 forms a flat surface for uniformly removing excess paint from the sleeve portion 16 of the roller. Accordingly, the height of the ribs 906 varies depending on the slope of the first portion 21*a* and second portion 21*b* of the ramp 21. An exemplary rib 906-1 therefore has its maximum height h1 at the outer edge of the inclined ramp 21 closest to the drain lines 902, 904 and its minimum height at the apex 21*c* of the ramp 21. Advantageously, additional excess paint is allowed to disperse from the sleeve portion 16 of the roller 14 while maintaining a flat surface for uniform displacement of excess paint across the sleeve portion 16 of the roller 14.

Thus there has been disclosed a paint kit consisting of a lid, tray and accompanying paint applicator, such as a paint roller assembly which has utility in the presence of paint as a wet paint storage unit and a paint kit consisting of a lid, tray and applicator which, when assembled, presents a neat compact eye pleasing appearance in all positions of display and a paint tray assembly consisting of a lid and tray if it is decided to sell the two items as a single item or as separate items.

Although a specific embodiment of the invention has been illustrated and described it will be appreciated from the foregoing description that modifications may be made without departing from the spirit and scope of the invention. Accordingly it is intended that the scope of the invention be limited solely by the scope of the hereafter appended claims when interpreted in light of the relevant prior art, and not by limitations set out in the foregoing specification.

What is claimed is:

1. A paint tray comprising:

a body portion comprising a bottom and a rear wall, front wall, and a pair of opposed sidewalls extending upward from said bottom, said front wall, rear wall and opposed sidewalls terminating in co-planar edges, said bottom comprising a reservoir portion adjacent said rear wall and an inclined ramp portion extending downwardly in a direction from said front wall to said reservoir portion;

an applicator rest extending inwardly from an interior surface of said rear wall and being disposed beneath said co-planar edges, said applicator rest being dimensioned to receive a handle portion of a paint roller with a sleeve portion of the paint roller being disposed on said bottom adjacent said front wall wherein said applicator rest comprises an upwardly opening protrusion; and a lid configured to releasably engage said co-planar edges around a perimeter of said body portion for sealing paint and said paint roller completely within the paint tray.

2. A paint tray according to claim 1, wherein said lid comprises an upwardly extending portion adjacent a first end thereof positioned over at least a portion of said sleeve portion of said paint roller when said lid is engaged with said co-planar edges and said handle of said paint roller is resting on said applicator rest with said sleeve portion of the paint roller being disposed on said bottom adjacent said front wall.

3. A paint tray according to claim 1, wherein said lid comprises a trough portion extending downwardly toward said reservoir portion when said lid is engaged with said co-planar edges.

4. A paint tray according to claim 3, wherein said trough portion is divided by an upwardly extending portion positioned over said handle of said paint roller when said lid is engaged with said co-planar edges and said handle of said paint roller is resting on said applicator rest with said sleeve portion of the paint roller being disposed on said bottom adjacent said front wall.

5. A paint tray according to claim 1, wherein said paint tray further comprises at least one downwardly extending leg adjacent to said front wall, wherein said at least one leg comprises a downwardly directed convex region.

6. A paint tray according to claim 1, wherein an exterior surface of said bottom comprises a downwardly extending convex portion adjacent said rear wall.

7. A paint tray according to claim 1 further comprising a concave region in said inclined ramp portion of said bottom adjacent to said front wall, said concave region extending parallel to said front wall.

8. A paint tray according to claim 1 further comprising a plurality of ribs disposed on said incline ramp portion.

9. A paint tray comprising:

a body portion comprising a bottom and a rear wall, front wall, and a pair of opposed sidewalls extending upward from said bottom, said front wall, rear wall and opposed sidewalls terminating in co-planar edges, said bottom comprising a reservoir portion adjacent said rear wall and an inclined ramp portion extending downwardly in a direction from said front wall to said reservoir portion;

an applicator rest extending inwardly from an interior surface of said rear wall and being disposed beneath said co-planar edges, said applicator rest being dimensioned to receive a handle portion of a paint roller with a sleeve portion of the paint roller being disposed on said bottom adjacent said front wall;

a towing feature extending inwardly from said front wall and being configured to engage said sleeve portion of said paint roller to facilitate towing of said paint tray using said paint roller; and a lid configured to releasably engage said co-planar edges around a perimeter of said body portion for sealing paint and said paint roller completely within the paint tray.

10. A paint tray according to claim 9, wherein said towing feature comprises a concave feature extending inwardly from and parallel to said front wall.

11. A paint tray comprising:

a body portion comprising a bottom and a rear wall, front wall, and a pair of opposed sidewalls extending upward from said bottom, said front wall, rear wall and opposed sidewalls terminating in co-planar edges, said bottom comprising a reservoir portion adjacent said rear wall and an inclined ramp portion extending downwardly in a direction from said front wall to said reservoir portion;

an applicator rest extending inwardly from an interior surface of said rear wall and being disposed beneath said co-planar edges, said applicator rest being dimensioned to receive a handle portion of a paint roller with a sleeve portion of the paint roller being disposed on said bottom adjacent said front wall;

a towing feature extending inwardly from said front wall and being configured to engage said sleeve portion of said paint roller to facilitate towing of said paint tray using said paint roller; and a lid configured to releasably engage said co-planar edges around a perimeter of said body portion for sealing paint and said paint roller completely within the paint tray, said lid comprising an upwardly extending portion adjacent a first end thereof for positioned over at least a portion of said sleeve portion of said paint roller when said lid is engaged with said co-planar edges and said handle of said paint roller is resting on said applicator rest with said sleeve portion of the paint roller being disposed on said bottom adjacent said front wall, and a trough portion adjacent a second end thereof, said trough portion extending downwardly toward said reservoir portion when said lid is engaged with said co-planar edges, said trough portion being divided by an upwardly extending portion positioned over said handle of said paint roller when said lid is engaged with said co-planar edges and said handle of said paint roller is resting on said applicator rest with said sleeve portion of the paint roller being disposed on said bottom adjacent said front wall.

12. A paint tray according to claim 11, wherein said towing feature comprises a concave feature extending inwardly from and parallel to said front wall.

13. A paint tray according to claim 11, wherein said paint tray further comprises at least one downwardly extending leg adjacent to said front wall, wherein said at least one leg comprises a downwardly directed convex region.

14. A paint tray according to claim 11, wherein said applicator rest comprises an upwardly opening protrusion.

15. A paint tray according to claim 11, wherein an exterior surface of said bottom comprises a downwardly extending convex portion adjacent said rear wall.

16. A paint tray according to claim 11 further comprising a concave region in said inclined ramp portion of said bottom adjacent to said front wall, said concave region extending parallel to said front wall.

17. A paint tray according to claim 11 further comprising a plurality of ribs disposed on said incline ramp portion.

* * * * *